United States Patent [19]

Haynes

[11] Patent Number: 4,494,784

[45] Date of Patent: Jan. 22, 1985

[54] DOOR-STOP FOR THE HANDICAPPED

[76] Inventor: Harvey H. Haynes, 333 Laurel Ct., Oxnard, Calif. 93030

[21] Appl. No.: 327,759

[22] Filed: Dec. 7, 1981

[51] Int. Cl.[3] ..... E05C 17/12; E05F 5/02

[52] U.S. Cl. ..... 292/233; 292/338; 292/DIG. 15; 16/82

[58] Field of Search ..... 16/82, DIG. 7, DIG. 20, 16/83, DIG. 8, DIG. 30; 292/21, 92, 196, 338, 336, 3, DIG. 15, 233

[56] References Cited

U.S. PATENT DOCUMENTS

| | | | |
|---|---|---|---|
| 638,139 | 11/1889 | Postle | 292/58 |
| 1,375,388 | 4/1921 | Haralson | 292/167 |
| 1,431,562 | 10/1922 | Bolles | 292/92 |
| 1,448,298 | 3/1923 | Hight | 292/DIG. 15 |
| 1,518,613 | 12/1924 | Teeter | 292/DIG. 15 |
| 1,545,176 | 7/1925 | Whyte | 292/92 |
| 1,630,141 | 5/1927 | Soemer | 292/21 X |
| 1,661,240 | 3/1928 | Trimbach | 292/5 |
| 3,645,572 | 2/1972 | McFarlane | 292/21 |
| 3,831,989 | 8/1974 | Gurzenda | 292/DIG. 15 |
| 4,295,673 | 10/1981 | Miller | 292/336.3 X |

*Primary Examiner*—E. R. Kazenske
*Assistant Examiner*—John S. Brown
*Attorney, Agent, or Firm*—David O'Reilly

[57] ABSTRACT

A door-stop for handicapped people and particularly people in wheel chairs which permits the person to push a self-closing door open and lock it in an open position before passing through the doorway. The door-stop is comprised of a pivoted cross bar mounted at a convenient height traverse to the door connected by means of a lever to a door-stop at the corner of the door. The door can thus be pushed open and the cross bar moved downward to lock the door-stop. After the person passes through the door, he can simply lift the cross bar to release the door-stop allowing the door to close.

8 Claims, 2 Drawing Figures

DOOR-STOP FOR THE HANDICAPPED

BACKGROUND OF THE INVENTION

This invention relates generally to door-stops and more particularly relates to a door-stop that may be utilized by handicapped persons in wheel chairs or other persons who require a convenient method to open, stop and release self-closing doors.

Self-closing doors present a particular problem to some handicapped persons and in particular handicapped persons in wheel chairs. They need to push open the heavy, spring-loaded doors and while holding the door open maneuver their wheel chair through the doorway. Often the assistance of another person is needed to hold the door in an open position or to push the wheel chair through the doorway.

One method of solving this problem is to provide sophisticated electronic self-opening doors that are actuated by a push-knob, floor sensor or remote sensor. These doors, of course, are expensive and not easily installed in buildings already constructed. Generally, they must be installed at the time of construction.

SUMMARY OF THE INVENTION

The purpose of the present invention is to provide a easily operated door-stop which can be utilized by a handicapped person such as a person in a wheel chair.

The door-stop of the present invention is comprised of a pivoted cross bar linked by a lever to a door-stop mounted at a corner of the self-closing door. The self-closing door may then be pushed open by a person seated in a wheel chair and the door-stop easily locked by releasing the cross bar attached to the door at a convenient height. A convenient height would generally be chest height of a person sitting in a wheel chair, which is approximately one third ($\frac{1}{3}$) of the way up the door or about 26 inches to 36 inches from the floor. The linkage or lever connecting the cross bar to the door-stop, moves the door-stop into position to stop or lock the door in an open position. The wheel chair may then be maneuvered through the doorway and the door-stop released by simply raising the cross bar to lock the door-stop in an up position.

It is one object of the present invention to provide a door-stop for self-closing doors, which may be easily operated by a person sitting in a wheel chair.

Another object of the present invention is to provide a door-stop for self-closing doors, which will permit a handicapped person to open and lock the door and pass through the door without assistance from others.

Another object of the present invention is to provide a door-stop for self-closing doors that can be easily and economically installed on existing structures.

Yet another object of the present invention is to provide an easily operable door-stop, which will permit self-closing doors to be easily locked in an open position while various equipment such as push-carts, motorized equipment, baggage, etc. can be carried through the opened door.

Other objects, advantages and novel features of the invention become apparent from the following detailed description when considered in conjunction with the accompanying drawings.

DESCRIPTION OF PREFERRED EMBODIMENT

Figure 1:
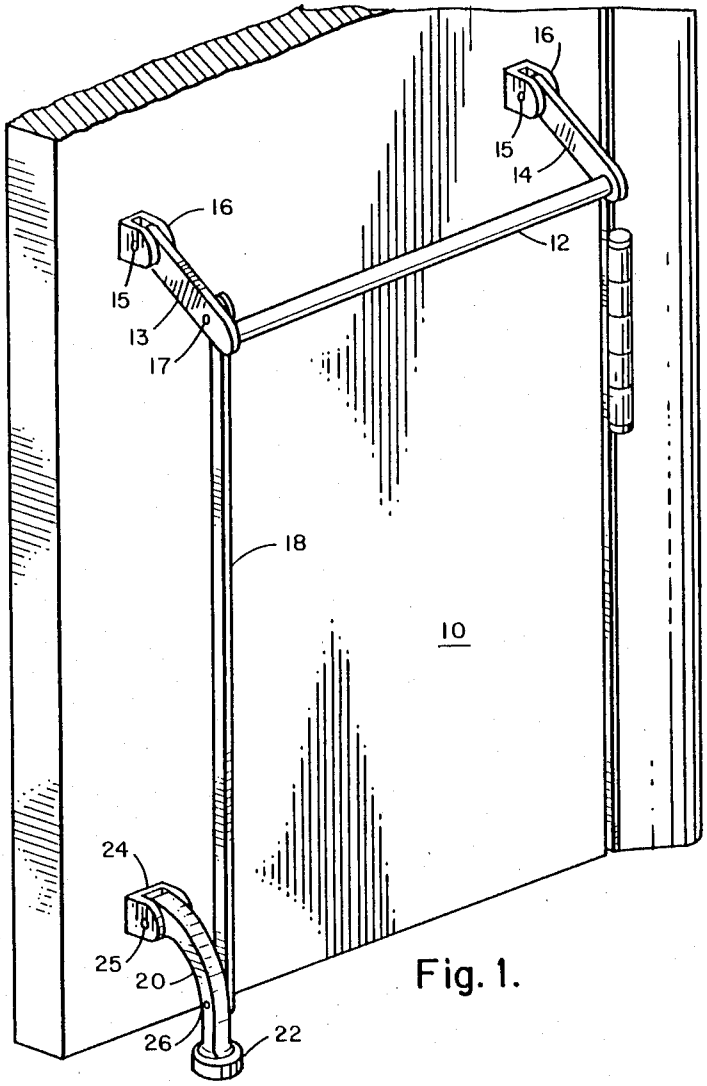
FIG. 1 is perspective view of the door, having the door-stop engaged in a locked position according to the invention.

A door-stop for use by handicapped persons, particularly persons in wheel chairs, is illustrated generally in FIG. 1. The door is generally a self-closing type door 10, which can be easily pushed open by a person in a seated position and then locked by means of the door-stop. The door-stop is comprised of a cross bar 12 mounted on the self-closing door 10 at a convenient location which is usually in the range of 26 inches to 36 inches from the floor. The cross bar 12 is attached to the door by means of brackets 13 and 14 secured by pivot pins 15 engaging door mount 16, which may be fastened to the door by adhesive, screws or any other suitable means.

A door-stop 20 is pivotedly secured to a lower corner of the door by means of a pin 25 engaging the mount 24 also fastened the door by any suitable means. The cross bar 12 operates the door-stop by means of a linkage or lever 18 secured by a swivel pin 17 attached to bracket 13 at one end and by a second swivel pin 26 engaging the door-stop 20. The door-stop 20 is provided with the usual rubber foot 22 for gripping or frictionally engaging the floor to prevent the door from slipping.

Figure 2:
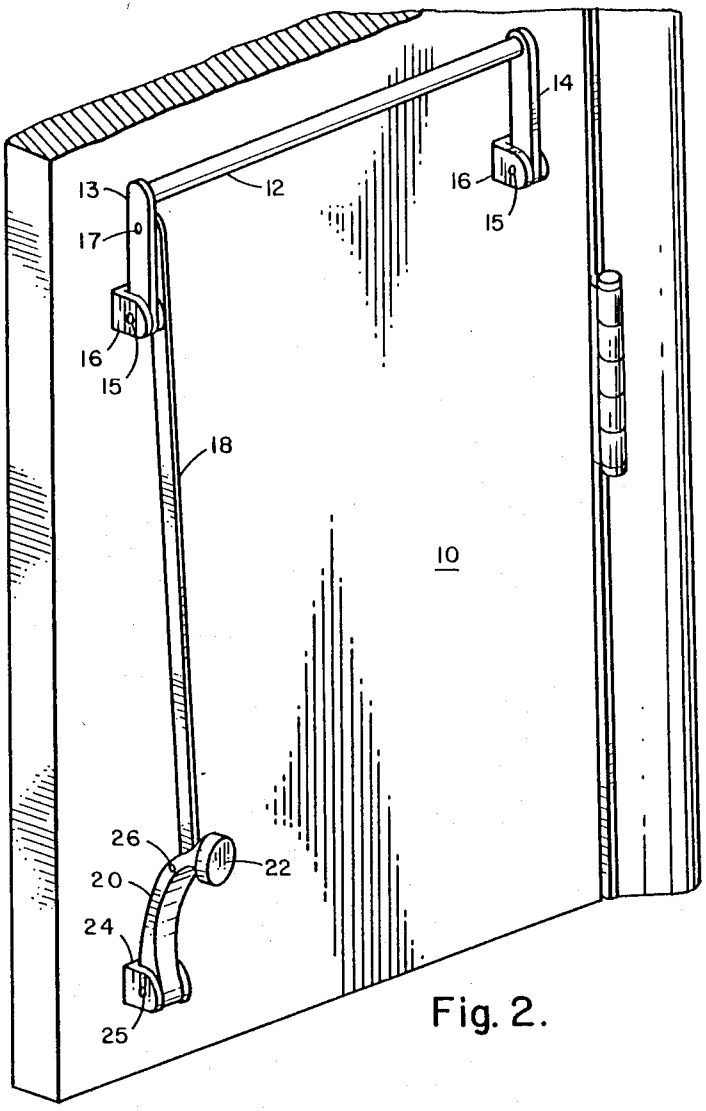
FIG. 2 is another perspective view of the invention showing the door-stop of the invention in the released position.

When the self-closing door 10 is not in use the cross bar 12 will be in a disengaged or "up" position as illustrated in FIG. 2. This will allow the door to swing freely with the door-stop remaining in the up position. Preferably the door mount 16 and pivot pins 15 extend sufficiently away from the surface of the door 10 to allow the cross bar 12 to swing into a "beyond center" position locking the door-stop in an up position. Alternatively, snap locks, magnetic latches, or leaf springs could be provided to hold the door-stop in the up position.

To operate the door-stop the self-closing door 10 is pushed open either by pushing on the door surface itself or grasping the cross bar 12. The cross bar 12 may then be moved downward to an engaged position to allow the door-stop rubber foot 22 to securely grip the floor surface. A "beyond center" positioning of the linkage pin 17 will permit the cross bar 12 to be pushed a sufficient distance downward to lock the door-stop in an engaged position. This would be particularly preferable of the very heavy spring-operated, self-closing doors. However, the "beyond center" locking of the door-stop would be designed to be sufficiently light so that it could be easily released from a seated position. Once the door is opened and in a locked position, it is a simple matter for the handicapped person in a wheel chair to easily maneuver the wheel chair through the doorway.

As was described previously, the door-stop may now be disengaged by lifting upward on the cross bar 12 to pivot the door-stop 20 to an "up" position. A novel, unique feature of the invention is that the door-stop 20 can be engaged or disengaged from the hinge side or from the open side of the door. Hence, a person in a wheel chair can approach the door from either direction, open the door and engage the door-stop 20, maneuver through the doorway and simply reach back and disengage the door-stop to close the door.

The door-stop 20, of course, can be any type of configuration such as a straight arm or an arm with a slight angle. However, preferably, the door-stop 20 has a cross section whose moment of enertia in the direction parallel to the door is greater than that perpendicular to the door. This novel construction allows the curved shaft forming the door-stop 20 to deflect more, and therefore store more strain energy, than that of a conventional door-stop. The strain energy is utilized as follows. Once the self-closing door 10 is pushed open, the door starts to close before the cross bar 12 can be moved to lock the door-stop in a "down" position. When the door-stop 20 is engaged, the force of the door closing will be transferred into the curved shaft of the door-stop 20, which will deflect and store elastic strain energy. When the door decelerates to zero, the curved shaft of the door-stop starts to spring back to its original shape, due to the strain energy being released. The force from the springing of the curved shaft forming the door-stop pushes the door open wider.

An overview of the operation of the door-stop of the invention utilizing the curved shaft shown is as follows:

(a) A self-closing door 10 is pushed open and starts to close.

(b) The cross bar 12 is "flipped" or pushed down which abruptly stops the door.

(c) The curved shaft deflects causing the door to rebound from the abrupt stop which tends to open the door wider.

(d) The door-stop 20 slides along the floor as the door tends to open wider then holds the door in the new open position.

Preferably the linkage of the cross bar 12 to the door-stop 20 is such that to engage the door-stop merely requires the user to flip the cross bar rather than having to apply any substantial downward force. Again, the linkage and pin construction are such that a slight upward flip of the cross bar will release the door.

Thus, there has been described a door-stop including a unique construction which allows a handicapped person, particularly a person in a wheel chair, to easily open and lock the self-closing door in the open position.

Obviously, many modifications and variations of the invention are possible in light of the above teaching. It is therefore to be understood that the full scope of the invention is not limited to the details disclosed herein, but only by the appended claims and may be practiced otherwise than as specifically described.

What is claimed is:

1. A self closing door in combination with a door stop mechanism, said door stop mechanism comprising:

an elongate bar pivotally mounted cross-wise of said door about a pivot at a height to be easily reachable from a sitting or standing position;

door-stop means pivotally mounted adjacent the lower edge of said door constructed and arranged to hold said door in an open position;

linkage means linking said bar to said door-stop means;

said linkage means being pivoted to said bar about a pivot axis parallel to said bar pivot axis;

said linkage means being constructed and arranged so that a downward force applied to said bar moves said linkage means pivot axis from an over-centered position above said bar pivot axis to a lowered non over-centered position to simultaneously pivot said door-stop from a raised position to a down position to hold said door open and an upward force on said bar moves said linkage means pivot axis from said non over-centered position to said over-centered position above said bar pivot axis to simultaneously pivot said door-stop means from said down position to said raised position; said over-centered position of said linkage means pivot axis locking said bar and said door-stop in a raised position to allow said door to return to a closed position;

whereby said door may be easily held open for passage and closed after passage therethrough.

2. The device according to claim 1 wherein said bar is substantially equal to the width of said door.

3. The device according to claim 2 including pivotally mounted arms mounted on opposite sides of said door, said bar secured to the outer ends of said arms whereby said bar pivot axis is defined by the pivot point of said arms.

4. The device according to claim 3 wherein said linkage means comprises a lever having one end pivoted to said bar and the other end pivoted to said door-stop means.

5. The device according to claim 4 wherein said door-stop means comprises a stop pivotally attached to a lower corner of said door.

6. A device according to claim 5 wherein said lever is pivotally attached to one of the arms pivotally mounting said bar.

7. The device according to claim 1 wherein said door-stop means is comprised of a deflectable curved shaft.

8. The device according to claim 7 wherein said door-stop means has a cross-section whose moment of inertia in the direction parallel to the door is greater than that perpendicular to the door.

* * * * *